US009291379B2

(12) United States Patent
Sakai et al.

(10) Patent No.: US 9,291,379 B2
(45) Date of Patent: Mar. 22, 2016

(54) AIR CONDITIONER

(75) Inventors: Tatsunori Sakai, Chiyoda-ku (JP); Masanori Aoki, Chiyoda-ku (JP); Hirokuni Shiba, Chiyoda-ku (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 798 days.

(21) Appl. No.: 13/148,783

(22) PCT Filed: Feb. 17, 2010

(86) PCT No.: PCT/JP2010/000971

§ 371 (c)(1),
(2), (4) Date: Aug. 10, 2011

(87) PCT Pub. No.: WO2010/103734

PCT Pub. Date: Sep. 16, 2010

(65) Prior Publication Data

US 2012/0023984 A1 Feb. 2, 2012

(30) Foreign Application Priority Data

Mar. 12, 2009 (JP) ..... 2009-059496

(51) Int. Cl.
*F25B 49/00* (2006.01)
*F04B 39/12* (2006.01)
*F25B 13/00* (2006.01)

(52) U.S. Cl.
CPC ..... *F25B 49/005* (2013.01); *F04B 39/121* (2013.01); *F04B 2201/0403* (2013.01);
(Continued)

(58) Field of Classification Search
CPC ..... F25B 49/005; F25B 2313/006; F25B 2700/2115; F25B 13/00; F25B 2313/0315; F25B 2500/27; F25B 2500/28; F25B 2313/02741; F25B 31/002; F25B 31/004; F04B 39/121; F04B 2201/0403
USPC ..... 62/84, 193, 472, 126, 129
See application file for complete search history.

(56) References Cited

U.S. PATENT DOCUMENTS 4,412,581 A * 11/1983 Iversen et al. ..... 165/240
4,444,017 A * 4/1984 Briccetti et al. ..... 62/84

(Continued)

FOREIGN PATENT DOCUMENTS

CN 2762014 Y 3/2006
JP 64008374 A * 1/1989

(Continued)

OTHER PUBLICATIONS

Office Action from Japanese Office Action, dated Jan. 8, 2013, issued in corresponding Japanese Patent Appln. No. 2009-059496, with English-language translation (7 pages).

(Continued)

*Primary Examiner* — Jonathan Bradford
*Assistant Examiner* — Kun Kai Ma
(74) *Attorney, Agent, or Firm* — Buchanan Ingersoll & Rooney PC

(57) ABSTRACT

In a compressor shell built in an outdoor unit of an air conditioner, a compressor shell thermistor that detects a temperature of the shell is installed. Also, an outside air temperature thermistor that detects an outside air temperature is installed in an outdoor unit. The outside air temperature is compared with the compressor shell temperature, and if the shell temperature is higher than the outside air temperature, a compressor heating device is invalidated. If the shell temperature is lower than the outside air temperature, it is determined as a refrigerant collection condition, and the compressor heating device is operated. Also, if the shell temperature is higher than the outside air temperature by a certain temperature or more, the operation of the compressor heating device is stopped so that wasteful standby power is reduced, and energy of the apparatus is saved.

8 Claims, 6 Drawing Sheets

(52) U.S. Cl.
CPC ..... *F25B13/00* (2013.01); *F25B 2313/006* (2013.01); *F25B 2313/02741* (2013.01); *F25B 2313/0315* (2013.01); *F25B 2400/01* (2013.01); *F25B 2500/27* (2013.01); *F25B 2500/28* (2013.01); *F25B 2700/2115* (2013.01)

(56) References Cited

U.S. PATENT DOCUMENTS

| | | | | |
|---|---|---|---|---|
| 5,230,222 | A * | 7/1993 | Erbs | 62/192 |
| 5,630,323 | A * | 5/1997 | Niijima et al. | 62/158 |
| 2010/0162742 | A1 | 7/2010 | Shimoda et al. | |
| 2012/0023984 | A1 | 2/2012 | Sakai et al. | |

FOREIGN PATENT DOCUMENTS

| | | | | |
|---|---|---|---|---|
| JP | 1-300149 | A | | 12/1989 |
| JP | 03045859 | A | * | 2/1991 |
| JP | 6-026716 | A | | 2/1994 |
| JP | 8-028987 | A | | 2/1996 |
| JP | 08028987 | A | * | 2/1996 |
| JP | 10-030563 | A | | 2/1998 |
| JP | 11-108473 | A | | 4/1999 |
| JP | 11-108474 | A | | 4/1999 |
| JP | 2001-073952 | A | | 3/2001 |
| JP | 2002-277075 | A | | 9/2002 |
| JP | 2005-083670 | A | | 3/2005 |
| JP | 2008-064447 | A | | 3/2008 |
| JP | 2008-170052 | A | | 7/2008 |
| JP | 2008170052 | A | * | 7/2008 |
| JP | 2010-210208 | A | | 9/2010 |

OTHER PUBLICATIONS

Office Action (Text Portion of the Notification of the First Office Action) from the Chinese Patent Office issued on Mar. 5, 2013 in corresponding Chinese Patent Application No. 201080011099.5 with an English language translation. (13 pages).

International Search Report (PCT/ISA/210) issued on May 25, 2010, by Japanese Patent Office as the International Searching Authority for International Application No. PCT/JP2010/000971.

Office Action (Patent Examination Report No. 1) dated Aug. 23, 2012, issued in corresponding Australian Patent Application No. 2010222517. (3 pages).

Office Action (Notice of Reasons for Rejection) issued on Jan. 7, 2014, by the Japanese Patent Office in corresponding Japanese Patent Application No. 2013-046477, and an English Translation of the Office Action. (10 pages).

Office Action (Notification of the Second Office Action) dated Oct. 25, 2013, issued by the Chinese Patent Office in the corresponding Chinese Patent Application No. 201080011099.5 and an English translation thereof. (10 pages).

Office Action (Decision of Rejection) issued on Apr. 25, 2014, in corresponding Chinese Patent Application No. 201080011099.5, and an English Translation of the Office Action. (12 pages).

Office Action (Decision of Refusal) issued on May 7, 2014, in corresponding Japanese Patent Application No. 2013-046477, and an English Translation of the Office Action. (2 pages).

Feb. 12, 2015 European Search Report issued in EP 10 75 0493.8.

Chinese Office Action issued Jun. 2, 2015 by the Chinese Patent Office in Chinese Application No. 201080011099.5 (5 pages) (with English language translation).

* cited by examiner

AIR CONDITIONER

TECHNICAL FIELD

The present invention relates to an air conditioner that forms a refrigerant circuit and performs cooling or heating and particularly relates to means which can prevent that a refrigerant present in the refrigerant circuit collects in a compressor while the apparatus is stopped, which would cause a problem of deterioration in insulation resistance, lubrication performance and the like.

BACKGROUND ART

In the case of an air conditioner constituting a refrigerant circuit, in general, the air conditioner includes each unit of an indoor unit and an outdoor unit and a pipeline that connects therebetween. As the configuration of the units, the indoor unit has an indoor-side heat exchanger, and the outdoor unit has an outdoor-side heat exchanger, a compressor, and a decompression device, which are connected to one another by the pipeline within the unit. The units formed thereby are connected by piping on an installation site and function as an air conditioner.

The inside of the refrigerant circuit formed by connecting the above units is filled with a refrigerant in general, and moreover, refrigerating machine oil that drives the compressor is also present in the refrigerant circuit. In general, if the outside temperature is low and the temperature inside the compressor is lower than the outside temperature and there is a temperature difference between the outside temperature and the temperature inside the compressor, a phenomenon in which the refrigerant collects in the compressor of the outdoor unit whose temperature becomes low, occurs. If the refrigerant collects in the compressor, the refrigerating machine oil is diluted by the refrigerant or liquefied refrigerant is left in a compressor chamber. If the compressor is started in this state, the refrigerating machine oil is discharged with the refrigerant, which results in a shortage of the refrigerating machine oil in the compressor, and compression of the collected liquid refrigerant increases a compressor load. Both of the factors cause failure in the compressor.

Thus, in order to avoid the above phenomenon, means that suppresses collection of the refrigerant while the air conditioner is stopped has been used in a compressor of an air conditioner in general by supplying electricity to a device for heating a shell (heater) or a motor in the compressor so as to heat the compressor. The timing at which this means is operated is determined using a predetermined outside temperature as a trigger, and a control technology of heating the compressor has been provided if the outside temperature is lower than the predetermined temperature or during the night when the outside temperature is lower than the predetermined temperature (See Patent Document 1).

Also, a control technology of starting supply of electricity to a shell heating device (crankcase heater) if a detected temperature of a shell temperature sensor falls under a detected value of every temperature detecting device in the air conditioner has been provided (See Patent Document 2).

CITATION LIST

Patent Literature

Patent Literature 1: Japanese Unexamined Patent Application Publication No. 10-030563 (pages 4 to 5, FIGS. 1 and 3)

Patent Literature 2: Japanese Unexamined Patent Application Publication No. 2008-170052 (pages 4 to 5, FIG. 1)

SUMMARY OF INVENTION

Technical Problem

In the above-described existing technologies, starting of the operation of a compressor heating device is determined by a time zone or a predetermined temperature, and it is likely that the compressor heating device will be operated even under the situation in which a refrigerant has not collected in the compressor. This results in an increase in standby power under the situation in which the air conditioner is stopped, which is inefficient. Also, if every temperature is compared with a shell temperature, there are many control factors and wasteful temperature detection spots, which results in a small effect despite complicated control, and frequent operation switching of the compressor heating device might bring about an inefficient state.

The present invention was made in order to solve the above-described problems of the prior-art technologies and an object thereof is to obtain an air conditioner in which, in a refrigerant circuit composed of a compressor, an indoor-unit heat exchanger, an outdoor-unit heat exchanger, a decompression device, and a four-way valve connected by piping, occurrence of refrigerant collection in the compressor is detected according to a detection condition of a compressor shell temperature and an outside temperature and starting of an operation of the compressor heating device is determined by the result so that simple and efficient prevention of refrigerant collection in the compressor can be realized.

Means for Solving the Problems

An air conditioner according to the present invention is provided with a compressor shell temperature detecting device that detects a shell temperature of a compressor constituting a refrigerant circuit, an outside air temperature detecting device that detects an outside air temperature, and a controller that determines occurrence of refrigerant collection in the compressor on the basis of an output of the compressor shell temperature detecting device, and an output of the outside air temperature detecting device, and a threshold value set in advance.

Advantageous Effects of Invention

According to the present invention, since the controller determines that the refrigerant collects inside the compressor shell when detecting the compressor shell temperature lower than the outside air temperature, the refrigerant collection in the compressor can be avoided by heating the compressor shell by operating the compressor heating device, which is advantageous.

DESCRIPTION OF EMBODIMENTS

Figure 1:
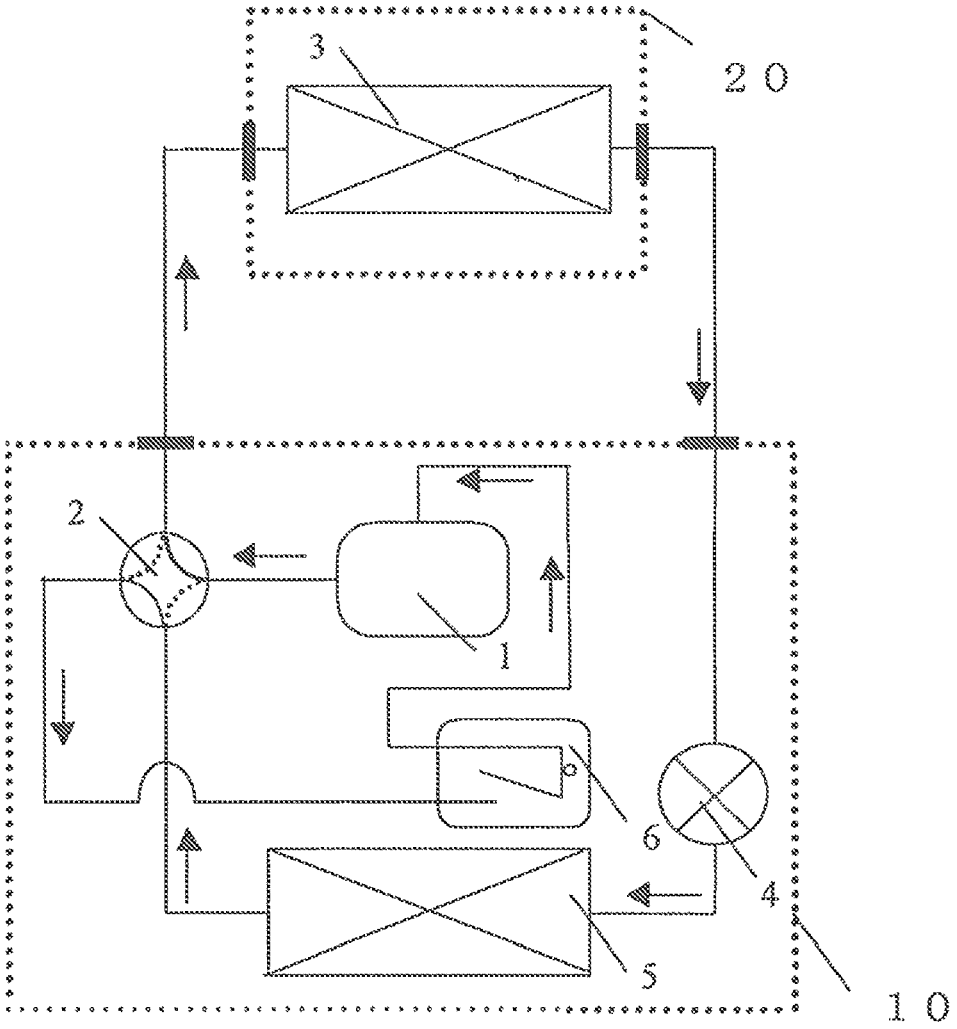
FIG. 1 is a configuration diagram illustrating a refrigerant circuit of an air conditioner in Embodiment 1 of the present invention.

Embodiments of the present invention will be described below by referring to the attached drawings. The same reference numerals are given to the same or corresponding portions in the figures and these descriptions will be omitted as appropriate.

Embodiment 1

FIG. 1 is a configuration diagram illustrating a refrigerant circuit of an air conditioner in Embodiment 1 of the present invention. As shown in FIG. 1, the air conditioner is composed of an outdoor unit 10, an indoor unit 20, and a pipeline that connects them. The outdoor unit 10 comprises a compressor 1, a four-way valve 2, a decompression device 4, an outdoor-unit heat exchanger 5, and an accumulator 6. Also, the indoor unit 20 comprises an indoor-unit heat exchanger 3.

In the refrigerant circuit in FIG. 1, the four-way valve 2 incorporated into the outdoor unit 10 has a role to change an advancing direction of the refrigerant circuit. The air conditioner having both functions of cooling and heating usually performs a cooling operation when a high-temperature and high-pressure refrigerant discharged from the compressor is fed into the outdoor-unit heat exchanger 5, and performs a heating operation when the refrigerant is fed into the indoor-unit heat exchanger 3. The four-way valve 2 has a role to switch the operation cycle and can freely switch the operation cycle by switching a slide valve in the four-way valve 2.

On the other hand, the decompression device 4 incorporated into the outdoor-unit 10 has a role to decompress a low-temperature and high-pressure liquid refrigerant condensed by the heat exchanger down to a pressure at which evaporation readily occurs. That is, after discharged from the compressor 1 and before reaching the decompression device 4 via a predetermined path in the refrigerant circuit corresponding to the operation cycle of cooling or heating, the refrigerant is maintained at the high pressure, and after passing through the decompression device 4 and before reaching an inlet of the compressor 1, the refrigerant comes to have a low pressure in the refrigerant circuit.

In the air conditioner composed of the above-described elements, refrigerating machine oil is present with the refrigerant in the refrigerant circuit. The refrigerating machine oil is present as lubricating oil for driving of the compressor. The refrigerating machine oil does not remain in the compressor continually. A small amount of the refrigerating machine oil is brought out from the inside of the compressor continually while the air conditioner is operated and is circulated with the refrigerant in the refrigerant circuit. If a large amount of the refrigerating machine oil is discharged from the inside of the compressor and the refrigerating machine oil becomes insufficient in a compressor driving portion, a driving shaft of the compressor might be burned and fail.

Also, the refrigerating machine oil can be diluted by being mixed with the refrigerant, and if the viscosity of the refrigerating machine oil is lowered by the dilution of the refrigerant, the refrigerating machine oil in the compressor becomes insufficient as above, the driving shaft of the compressor might be burned and fail.

An insufficient state of the refrigerating machine oil is mainly caused by collection of the refrigerant in the compressor in general. As the refrigerating machine oil, the one having compatibility with the refrigerant is generally used, and as the temperature of the compressor is cooled when the air conditioner is stopped, the refrigerant flows in from an external refrigerant circuit. If there comes to be a large amount of refrigerant in the compressor as above, the refrigerant dissolves into the refrigerating machine oil (this is called "stagnation" of the refrigerant in the refrigerating machine oil) and leads to dilution of the refrigerating machine oil by the refrigerant and an increase in a brought-out amount of the refrigerating machine oil in the operation in the next time.

Particularly if the temperature inside the compressor is low, the refrigerant is liquefied inside the compressor. In this case, the liquid refrigerant also comes to be in the compression portion, which results in an increase in a compression load during the operation of the compressor and can cause deterioration or failure of the device.

In the air conditioner, factors of the collection of the refrigerant in the compressor include a lowered temperature of the compressor. When the air conditioner stops operating, pressures that were different in the refrigerant circuit gradually change and become equal, and at this time, the refrigerant moves to a portion with a lower temperature and a lower pressure. Here, if the compressor is brought into a state in which the temperature and the pressure are lower than the periphery, the refrigerant gradually collects inside of the compressor, and a state of the collection of the refrigerant as above which causes the compressor to fail is brought about.

One of means to solve the above problem is a method of heating the compressor. Examples of a compressor heating device 24 include a heater mounted on the shell outside portion and a motor inside the compressor and by supplying electricity to this motor, the compressor can be heated by the effect of the heat generated by the motor. Since the mounting of said heater can raise the cost of the air conditioner, the method of supplying electricity to a motor is preferable in this embodiment.

If motor heating is performed as a measure for preventing collection of the refrigerant in the compressor, electricity needs to be supplied after it is determined that collection of the refrigerant has occurred. This is because continual supply of electricity leads not only to an increase in standby power but also to a reduction in the life time of the compressor motor. Therefore, the motor needs to be heated in an appropriate situation.

In this embodiment, a device that detects a compressor shell temperature and an outside air temperature or a thermistor, for example, is installed in the air conditioner. A thermistor is a device mounted in general as means that detects/controls a temperature used in control of the air conditioner and is widely used as a detecting device with sufficient accuracy in executing appropriate control and with a lower price.

Figure 2:
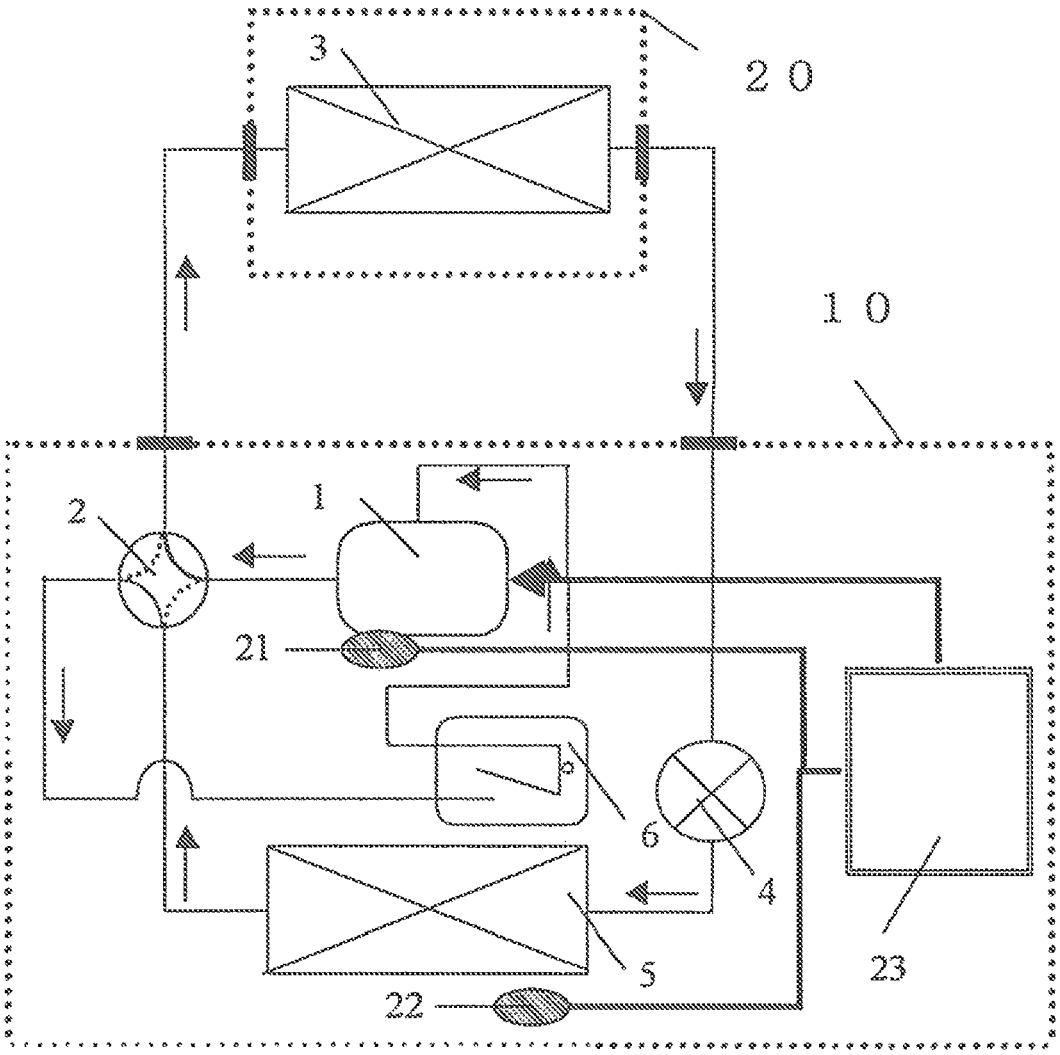
FIG. 2 is a diagram illustrating a temperature detection spot and a control method when a compressor heating device of the air conditioner according to the present invention is used for the refrigerant circuit.

In order to realize this embodiment, since at least a compressor shell temperature 21 and an outside air temperature 22 need to be detected, the thermistor needs to be mounted as shown in FIG. 2. Also, as a controller that determines a detection condition of the above two temperatures and whether to supply electricity to the compressor motor, a control board 23 is needed.

Subsequently, an operation of the control board 23 will be described.

The control board 23 compares the compressor shell temperature and the outside air temperature, and if a conditional expression (1) is true, heating of the compressor motor, that is, supply of electricity to the motor is allowed.

$$[\text{compressor shell temperature}] \leq [\text{outside air temperature}] - \alpha (\alpha = 3^\circ \text{ C., for example}) \quad (1)$$

If it is determined that the compressor shell temperature is substantially equal to the outside air temperature, it is highly likely that the refrigerant collects inside the compressor. Therefore, the control board 23 operates the compressor heating device 24 so as to heat the compressor 1 and to avoid refrigerant collection inside the compressor. Under the above condition, if the outside air temperature is high, the probability of refrigerant collection is low, but if the temperature is at least equal to or lower than the outside air temperature, it is likely that the refrigerant existing on the outdoor unit side collects in the compressor. Thus, it is preferable that the condition is not set in accordance with the outside air temperature.

If the above condition is satisfied, and the following conditional expression (2) becomes true while the electricity is supplied to the compressor motor, the control board 23 does not perform heating of the compressor motor, that is, does not supply electricity to the motor.

$$[\text{compressor shell temperature}] > [\text{outside air temperature}] + \alpha \quad (2)$$

The above conditional expression (2) is a condition that deviates from the conditional expression (1), that is, it is considered to be a phenomenon that the refrigerant collection inside the compressor is avoided. If it is determined that the compressor temperature is apparently higher than the outside air temperature, there is considered to be a large amount of refrigerant in the outdoor heat exchanger or the accumulator than in the compressor, and the refrigerant amount inside the compressor is an amount determined to be of no problem for driving. Therefore, excessive heating of the compressor under this condition is wasteful as a standby power amount and determined to be an inefficient state, and thus, it is preferable not to supply electricity.

Also, both the above expressions (1) and (2) are effective all the time and are assumed to be effective all the time as long as power is supplied to the air conditioner.

Figure 3:
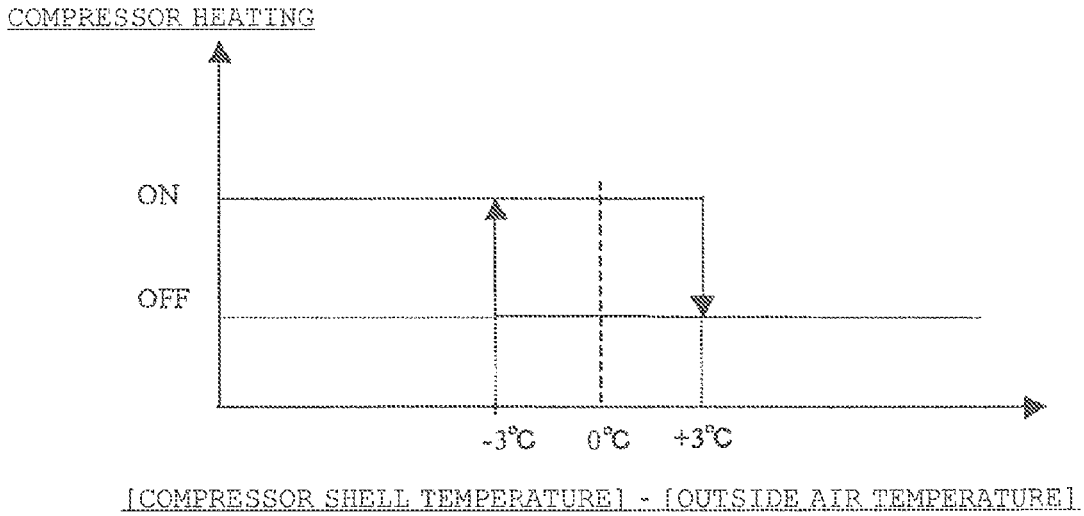
FIG. 3 is a control hysteresis diagram (No. 1) illustrating an example of an ON/OFF condition of the compressor heating control method in the present invention.

Here, a constant $\alpha$, shown in the above expressions (1) and (2) will be described. The constant $\alpha$ here is a control constant for formulating a temperature condition at which electricity is supplied to the compressor motor by using hysteresis as shown in FIG. 3. As described above, if it is determined whether to supply electricity to the compressor motor or not on the basis of the compressor shell temperature and the outside air temperature, a hunting phenomenon of the electricity supply operation when the compressor shell temperature is close to the outside air temperature, that is, a phenomenon of repeated supplying/non-supplying of electricity in a short time is a concern. Thus, in order to avoid the phenomenon of frequent repeating of the electricity supply operation, the control temperature condition is preferably set to hysteresis by using the constant $\alpha$.

In order to avoid the hunting phenomenon during the electricity supply operation, there is means for forcedly avoiding the hunting phenomenon by providing a prohibition time during which the electricity is turned ON again when switching from ON to OFF. However, since this form is changing constantly due to various factors such as the thickness of the compressor shell, the heat insulation situation around the shell and the like, the setting of the prohibition time needs to be adjusted for each device, which is inconvenient. Therefore, the method of determining whether to supply electricity or not to the compressor motor by setting the control temperature condition as above on the basis of hysteresis without relying on the device situation is more convenient.

Figure 6:
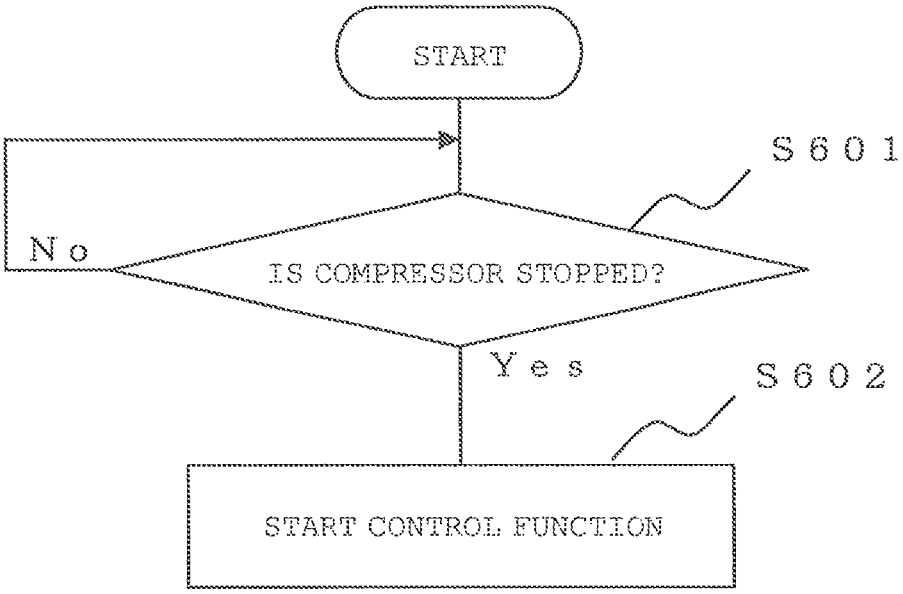
FIG. 6 is a flowchart (No. 1) illustrating an operation of a control board 23 in Embodiment 1 of the present invention.
Figure 7:
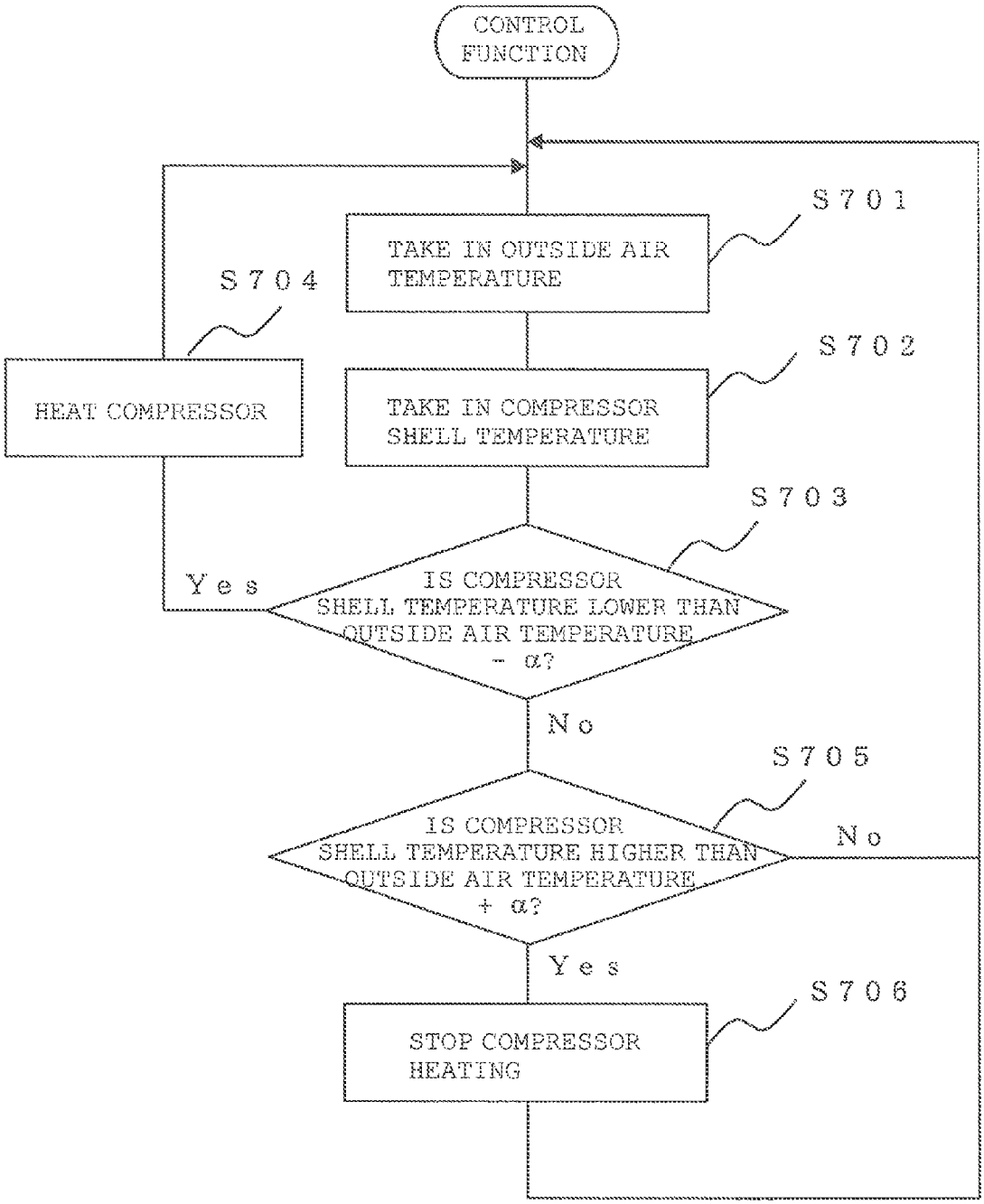
FIG. 7 is a flowchart (No. 2) illustrating an operation of the control board 23 in Embodiment 1 of the present invention.

FIGS. 6 and 7 are flowcharts illustrating an operation of the control board 23 in Embodiment 1 of the present invention. FIG. 6 is a flowchart regarding starting a function relating to a main control of the control board (hereinafter referred to as a control function). FIG. 7 is a main flowchart indicating an operation flow for the control function of the control board.

Subsequently, the operation of the control board 23 will be described using FIGS. 2 and 6.

The control board 23 operates in accordance with the starting flowchart in FIG. 6 when power is turned on, stands by while repeatedly executing Step S601 until the compressor is stopped, and, when the compressor 1 is stopped (Yes at Step S601), starts the control function (Step S602).

When the control function is started, first, in accordance with the flow in FIG. 7, the control board 23 takes in the outside air temperature detected by the outside air temperature thermistor 22, and also takes in the shell temperature of the compressor detected by the compressor shell thermistor 21 (Steps S701 to S702). Subsequently, the control board 23 compares a shell temperature TCS of the compressor with a temperature TO1 obtained by subtracting a threshold value $\alpha$ from an outside air temperature TO (Step S703) and if the shell temperature TCS of the compressor is lower than the temperature TO1, the control board 23 determines that the refrigerant collects inside the compressor 1, operates the heating device so as to heat the compressor 1 (Step S704) and returns to Step S701. If the shell temperature TCS of the compressor is not lower than the temperature TO1 in the comparison at Step S703, the control board 23 determines that the refrigerant has not collected in a large quantity in the compressor 1 and then, compares the shell temperature TCS of the compressor with a temperature TO2 obtained by adding the threshold value $\alpha$ to the outside air temperature TO (Step S705). If the shell temperature TCS of the compressor is higher than the temperature TO2, the refrigerant has not collected in the compressor 1 and then, the control board stops the operation of the compressor heating device so as to stop wasteful heating of the compressor (Step S706) and then, returns to Step S701. Also, if the shell temperature TCS of the compressor is not higher than the temperature TO2 in the comparison at Step S705, the control board 23 does nothing and returns to Step S701.

Also, two reasons why the constant $\alpha$ is set at 3° C. will be described.

First, it is to avoid the hunting phenomenon of the frequent electricity supply operation described above by widening a temperature range to 6° C. ($2\alpha$), which becomes a condition to determine whether to supply electricity or not to the compressor motor. The thermistor is used as the temperature detecting means as an example to realize the above form, but an error might occur in a detected temperature. Therefore, if the value of $\alpha$ is small, frequent electricity supply switching due to a thermistor detection error is prevented, and even if there is few errors in the condition, a cycle time for repeated electricity supply switching is extended, which is advantageous.

The second reason is a temperature difference between the compressor shell temperature and the compressor internal temperature. In general, a heat passage amount generated between inside and outside the vessel is indicated by the following equation (3):

$$Q=A\cdot K\cdot \Delta T \quad (3)$$

where Q: heat passage amount (W), A: heat transfer area (m2), K: heat passage rate (W/m2k), ΔT: temperature difference between the inside and outside (K). Since the compressor shell is made of an iron material in general, the heat passage rate is lower than the other materials used in a refrigerant circuit such as aluminum or copper. Moreover, since the compressor shell needs to be provided with high pressure resistance ability, the compressor shell is made thick. As a result, a temperature difference is generated between a temperature detected by the thermistor mounted on the compressor shell outer shell and a refrigerant temperature inside the shell. Considering this temperature difference, a threshold value $\alpha=3°$ C. is set as a value to determine collection of the refrigerant by using the difference between the shell outer shell temperature and the outside air temperature.

On the other hand, for a general phenomenon, the control means by using the above equations (1) and (2) is sufficient, in order to further improve reliability of suppression of compressor failure caused by the refrigerant collection phenomenon however, the control board 23 is capable of changing the equations (1) and (2) to (4) and (5), respectively, as follows:

$$[\text{compressor shell temperature}]\leq[\text{outside air temperature}]-\alpha+\beta(\beta=2°\text{ C., for example}) \quad (4)$$

$$[\text{compressor shell temperature}]>[\text{outside air temperature}]+\alpha+\beta \quad (5)$$

Figure 4:
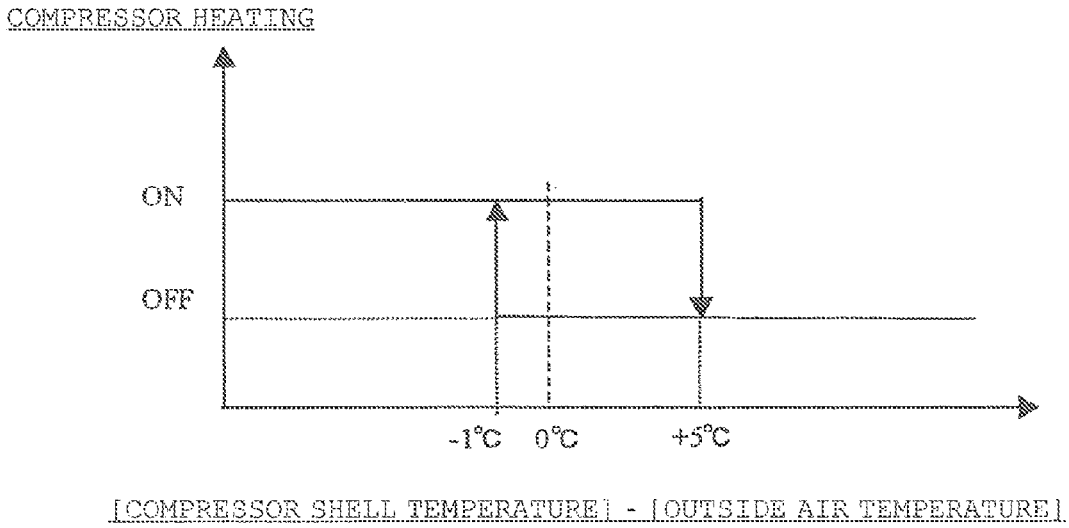
FIG. 4 is a control hysteresis diagram (No. 2) illustrating an example of an ON/OFF condition of the compressor heating control method in the present invention.

If the compressor heating device is to be operated even when a phenomenon occurs for which it is difficult to determine the refrigerant collection operation such that the compressor is extremely susceptible to an oil dry-up operation or a thermistor detection accuracy is poor, the control board 23 controls whether or not to start operation of the compressor heating device using the above equations (4) and (5) as FIG. 4 shows. However, if the numeral value of the constant β is large, the degree of protection becomes excessive, which might result in an increase of a standby power amount and deterioration of a compressor life and requires caution.

Since the control method in this embodiment is means that can directly determine refrigerant collection in the compressor and also avoid the collection phenomenon in a required minimum power supply time, the standby power amount while the air conditioner is stopped can be avoided as much as possible and is a useful method for energy saving for the entire apparatus.

In this embodiment, whether refrigerant collection is occurring in the compressor is determined only by using required minimum equipment and simple control equations and then electricity is supplied or not to the compressor motor and thus, the means can be introduced to a general air conditioner easily and is means that can be widely utilized in a refrigerant circuit in general constituting a refrigerant circuit using a compressor, which is useful.

Embodiment 2

Figure 5:
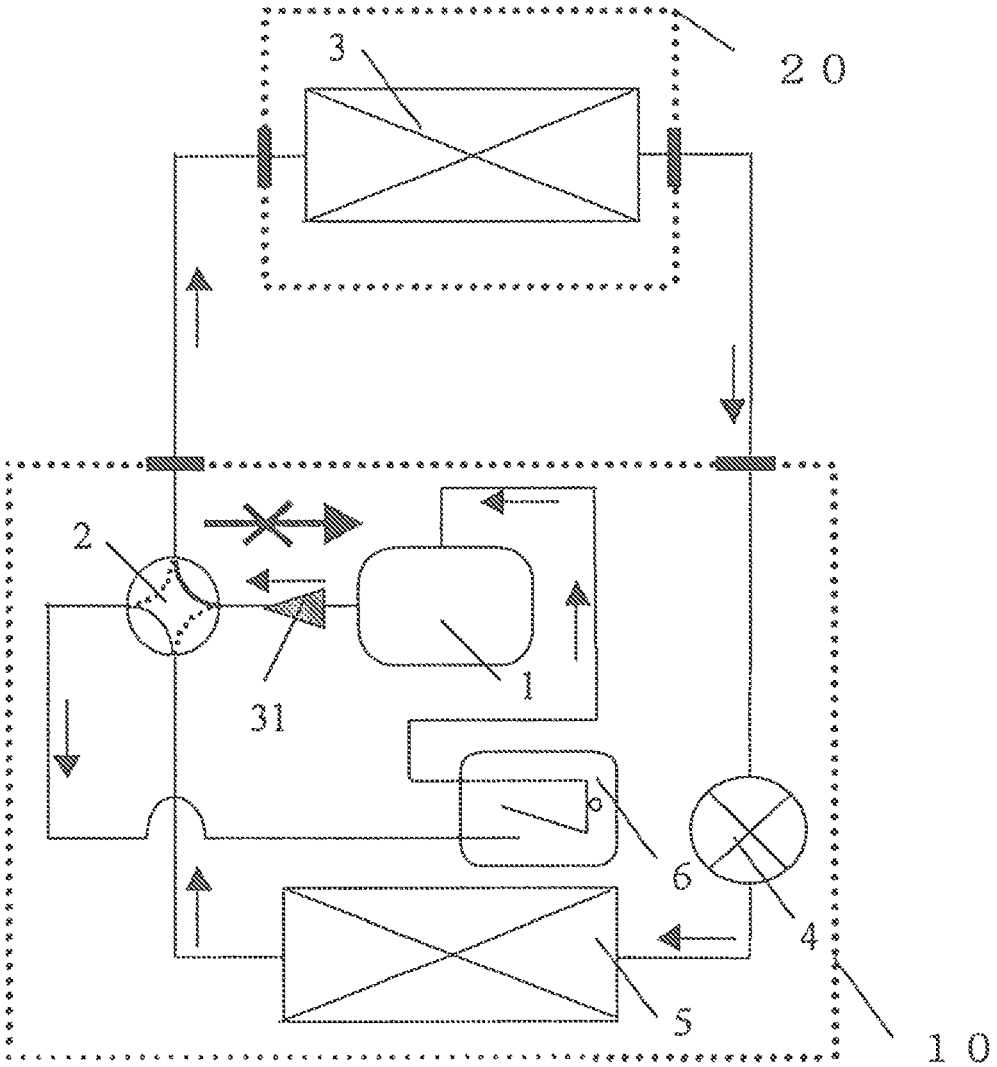
FIG. 5 is a refrigerant circuit to which a discharge-side check valve with a purpose of alleviating a load of the compressor heating control method of the present invention is added.

On the other hand, in the refrigerant circuit having the structure as in FIG. 1 described in Embodiment 1, if a check valve 31 is provided in the refrigerant circuit on the compressor discharge side as shown in FIG. 5, reduction of a load by the compressor heating control method shown in Embodiment 1 is expected.

This form will be described in this embodiment.

The refrigerant collection in the compressor is a phenomenon generated by inflow of the refrigerant circuit into the compressor side when the compressor is brought into a low-pressure and low-temperature state while the air conditioner is stopped as described above. This phenomenon occurs not only as a flow from the low-pressure suction side but also as a counterflow from the high-pressure discharge side. Thus, by adding a check valve onto the discharge side, the refrigerant discharged to the heat exchanger connected to a compressor discharge pipe from the discharge side is prevented from flowing backward to the compressor into the compressor and a refrigerant amount collecting in the compressor can be reduced.

The biggest advantage of this structure is that an electricity supply time to the compressor heating device can be reduced. That is, in the compressor heating control, the refrigerant state is maintained in a gas state by giving heat to the refrigerant, and a factor of a compressor failure caused by dilution of the refrigerating machine oil and a liquid refrigerant can be avoided. If the refrigerant in the compressor is brought into a gas state by heating the compressor, the refrigerant more than necessary flows to the discharge side.

According to this embodiment, by providing a structure of a check valve on the discharge side as above, not only that the refrigerant amount flowing backward from the discharge side is suppressed, but return to cooling of an excess refrigerant discharged by compressor heating can be prevented. Therefore, energy consumption by the compressor heating can be made small even during standby for a long time.

Embodiment 3

On the other hand, in the refrigerant circuit having the structure as in FIG. 1 described in Embodiment 1, by performing a pump-down operation when the operation of the compressor heating device is stopped, reduction of a load by the compressor heating control method shown in Embodiment 1 can be expected.

This form will be described in this embodiment.

The pump-down operation is an operating method for collecting the refrigerant diffused into the refrigerant circuit to the outdoor unit side and is mainly used when the air conditioner is removed or the like. In this embodiment, the decompression device is turned down as much as possible so that the refrigerant collected on the low pressure side is moved to the discharge side or, more specifically, the indoor heat exchanger during the heating operation.

By expelling the refrigerant separated from oil by the operation of the compressor heating device to the discharge side by the pump-down operation so as to reduce the refrigerant amount remaining inside the compressor, energy consumption by the compressor heating can be kept small even during standby for a long time.

Moreover, in the air conditioner having the structure as in FIG. 5 described in Embodiment 2, if the above-described pump-down operation control is added, energy consumption by the compressor heating can be further kept small by a synergetic effect even during standby for a long time.

Embodiment 4

In the refrigerant circuit as in FIG. 1 or 5, by performing the above-described pump-down operation while the air conditioner is stopped, the refrigerant diffused in advance and remaining on the refrigerant circuit low-pressure side can be discharged and collected on the discharge side of the compressor, and the refrigerant amount existing in advance in the compressor becomes small when the operation is stopped. That is, the energy consumption by the compressor heating can be kept small even during standby for a long time.

REFERENCE SIGNS LIST

1 compressor, 2 four-way valve, 3 indoor-side heat exchanger, 4 decompression device, 5 outdoor-side heat exchanger, 6 accumulator, 10 outdoor unit, 20 indoor unit, 21 compressor shell thermistor, 22 outside air temperature thermistor, 23 control board, 24 compressor heating device, 31 compressor check valve

The invention claimed is:

1. An air conditioner comprising:

a compressor shell temperature detecting device that detects a shell temperature of a compressor that constitutes a refrigerant circuit;

an outside air temperature detecting device that detects an outside air temperature;

a compressor heater that heats the shell of said compressor;

a controller that determines occurrence of refrigerant collection in said compressor on the basis of an output of said compressor shell temperature detecting device, an output of said outside air temperature detecting device, and a threshold value set in advance;

said controller operates said compressor heater to heat the shell of said compressor if the controller determines that refrigerant collection in said compressor has occurred on the basis of the output of said compressor shell temperature detecting device, the output of said outside air temperature detecting device, and said threshold value; and said controller stops an operation of said compressor heater and performs a pump-down operation so as to expel the refrigerant separated by said compressor heater from the oil to a discharge side and reduces a refrigerant amount remaining inside said compressor if the controller detects the output of said compressor shell temperature detecting device is a higher temperature than the output of said outside air temperature detecting device by the value set in advance or more.

2. The air conditioner of claim 1, wherein said controller determines that refrigerant collection in said compressor has occurred if the output of said compressor shell temperature detecting device is lower than or equal to the output of said outside air temperature detecting device by the threshold value set in advance.

3. The air conditioner of claim 1, wherein said controller stops operation of said compressor heater if the temperature of the output of said compressor shell temperature detecting device is detected to be greater than the output of said outside air temperature detecting device added to the threshold value set in advance.

4. The air conditioner of claim 1, wherein said threshold value has hysteresis.

5. The air conditioner of claim 1, further comprising: a heat exchanger connected to a discharge-side pipeline of said compressor, wherein a refrigerant counterflow preventer is disposed on the discharge side of said compressor, and configured to prevent a counterflow from said heat exchanger to said compressor caused by the refrigerant discharged from said compressor.

6. The air conditioner of claim 1, wherein said compressor shell temperature detecting device and said outside air temperature detecting device are formed by thermistors.

7. The air conditioner of claim 1, wherein said compressor heater is mounted on the shell outer part of said compressor or a motor inside said compressor.

8. A method of controlling an air conditioner having a compressor shell temperature detecting device that detects a shell temperature of a compressor that constitutes a refrigerant circuit, an outside air temperature detecting device that detects an outside air temperature, a compressor heater that heats the shell of said compressor, and a controller that determines occurrence of refrigerant collection in said compressor on the basis of an output of said compressor shell temperature detecting device, an output of said outside air temperature detecting device, and a threshold value set in advance, the method comprising:

heating, by said compressor heater, the shell of said compressor when said controller determines the occurrence of refrigerant collection in said compressor;

stopping heating of the shell of said compressor and performing a pump-down operation so as to expel the refrigerant separated by said compressor heater from the oil to a discharge side, when said controller detects the output of said compressor shell temperature detecting device is a higher temperature than the output of said outside air temperature detecting device by the value set in advance or more.

* * * * *